US007442157B2

(12) United States Patent
De Matteis

(10) Patent No.: US 7,442,157 B2
(45) Date of Patent: Oct. 28, 2008

(54) STRUCTURE OF INTERFOLDING MACHINE

(75) Inventor: Alessandro De Matteis, Lucca (IT)

(73) Assignee: MTC-Macchine Trasformazione Carta S.R.L., Lucca (IT)

( * ) Notice: Subject to any disclaimer, the term of this patent is extended or adjusted under 35 U.S.C. 154(b) by 0 days.

(21) Appl. No.: 11/675,379

(22) Filed: Feb. 15, 2007

(65) Prior Publication Data

US 2007/0197365 A1 Aug. 23, 2007

(30) Foreign Application Priority Data

Feb. 18, 2006 (EP) ..... 06003347

(51) Int. Cl.
*B31B 1/96* (2006.01)

(52) U.S. Cl. ..... 493/411; 493/379; 493/430; 493/433; 493/448; 270/39.01; 270/39.02; 270/39.05; 270/39.06

(58) Field of Classification Search ..... 493/379, 493/409–412, 430, 433, 434, 448, 416–417; 270/39.01, 39.02, 39.05, 39.06
See application file for complete search history.

(56) References Cited

U.S. PATENT DOCUMENTS 2,420,525 A * 5/1947 Deloye ..... 225/96
3,163,413 A * 12/1964 Franke et al. ..... 493/35
3,229,974 A * 1/1966 Banks ..... 493/359
4,725,469 A * 2/1988 Summerfield ..... 428/43
4,824,426 A * 4/1989 DuFresne ..... 493/346
4,874,158 A * 10/1989 Retzloff ..... 270/39.02
6,165,116 A * 12/2000 White ..... 493/360
7,306,554 B2 * 12/2007 Couturier et al. ..... 493/427
7,329,221 B2 * 2/2008 Haasl et al. ..... 493/428

FOREIGN PATENT DOCUMENTS

GB 628053 8/1949

* cited by examiner

*Primary Examiner*—Hemant M Desai
(74) *Attorney, Agent, or Firm*—Dennison, Schultz & MacDonald

(57) ABSTRACT

An interfolding machine for sheet material for making a stack of interfolded sheets includes at least one web of material to interfold that is cut into sheets of predetermined length and rolls for partially overlapping the sheets in order to form an overlapped portion between two consecutive sheets. Interfolding rolls are also provided, adapted to produce the stack, as well as a conveyor adapted to convey the partially overlapped sheets in a zone set between the roll and the interfolding rolls. Further, the overlapping portion of the sheets is maintained constant through a plurality of belts and guides facing the belts so that between the belts and the respective guides a channel is formed for conveying the partially overlapped sheets.

8 Claims, 3 Drawing Sheets

STRUCTURE OF INTERFOLDING MACHINE

FIELD OF THE INVENTION

The present invention relates to the production of paper material in stacks of interfolded sheets and, in particular Z interfolded sheets.

BACKGROUND OF THE INVENTION

As well known, in paper converting industry a variety of types of machines and of processes exists for making paper tissues, paper towels and the like by producing stacks of interfolded sheets of a certain height.

They are obtained folding the sheets in an "interfolded" way, namely are folded into panels by overlapping at the same time a panel of a previous sheet with a panel of a following sheet. In this way, when pulling a sheet from the stack, at the moment of the use also a panel of the following sheet is pulled out, with consequent advantages for certain types of uses. Among the possible interfolding ways, stacks of Z interfolded sheets are known.

Machines are known that use one or more webs of paper, coming from one or more reels, that are cut into sheets and then supplied offset with respect to one another on folding counter-rotating rollers.

More precisely, the webs are cut into sheets by means of cutting rollers that interact alternatively, with relative counter-support rollers.

The overlap between two consecutive sheets occurs just after the cutting step and a sequence of overlapping and offset sheets come to the folding rollers from only one direction.

The interfolded stacking step is accomplished with the aid of folding elements, which in case of rollers with mechanical folding means, consist of mechanical clamps incorporated in the roller.

More precisely, the cut sheets proceed on a first roller that rotates at a first speed. Then, the pass on a second roller, called "overlap" roller, which rotates at a second speed less than the first. This way, owing to this speed difference a sheet travelling upstream is quicker and partially overlaps a sheet travelling downstream, slower, which is raised by means of air blows. The overlapping is carried out for about a third of the sheets sheet length, in order to allow the Z interfolding arrangement, after the passage through the interfolding rollers.

Between the overlapping roller and the interfolding rollers a conveying system is normally provided having opposite belts, adapted to convey the partially overlapped sheets. The two belts are counter-rotating and travel at the same speed, keeping the sheets pressed on one another.

The belts are opposite and consist of a plurality of parallel strings, which extend for all the sheet length of the rollers. To avoid that they loose the desired overlapped condition of a third of their sheet length, the belts must partially to penetrate each other, causing the sheets to deform.

Furthermore, the presence of opposite belts is a structural complication for the machine, thus affecting the encumbrance and the costs.

SUMMARY OF THE INVENTION

It is therefore a feature of the present invention to provide an interfolding machine that produces stacks of Z interfolded sheets, which allows to overcome the above drawbacks.

This and other objects are accomplished by the structure of interfolding machine, according to the present invention, for making a stack of interfolded sheets comprising:

at least one web of material to interfold that is cut into sheets of predetermined length;

means for partially overlapping the sheets in order to form an overlapped portion between two consecutive sheets, where the overlapped portion is a predetermined fraction of said sheet length;

interfolding means adapted to make said stack;

conveying means adapted to convey the partially overlapped sheets in a region set between the means for partially overlapping and the interfolding means, means for keeping unchanged the overlapping fraction of the sheets, comprising a plurality of belts and a plurality of fixed guides facing the belts so that between the belts and the respective guides a channel is formed for conveying the partially overlapped sheets;

and where the belts have a plurality of teeth oriented towards the guides, the teeth being distanced from each other such that least at one tooth coincides with a respective overlapped portion, and pushes the overlapped portion against a respective guide, so that the conveying means can convey the partially overlapped sheets along the channel preventing the overlapping fraction of the sheets from changing.

Preferably the conveying means comprises a couple of conveying rollers arranged along the channel, whereby at an overlapping zone in the channel upstream from the conveying rollers, where the conveying rollers can only convey the downstream sheet two overlapping sheets, and the overlapping fraction of the sheets remains unchanged owing to the pressure of the upstream sheet against the downstream sheet and against the guides caused by a tooth, so that the upstream sheet is kept pressed against the sheet downstream at the overlapping portion, obtaining a conveying contribution.

Advantageously among the guides rotatable support rollers for the sheets are provided, the rollers having a boundary that protrudes in the channel and have a peripheral speed equal to the belts.

Preferably the means for overlapping provide an overlapping roller and a transfer roller, the transfer roller rotate at a speed higher than the overlapping roller in order to deposit on the overlapping roller the sheets overlapped according to the overlapping fraction.

Advantageously the overlapping fraction is ⅓ of the sheet length, so that a stack of Z interfolded sheets is obtained.

Preferably the overlapping roller provides a plurality of grooves wherein the belts can pass.

Advantageously the belts run parallel to the guides up to a point as close as possible to the interfolding means, at such point means being provided for deviating the belts, whereby the overlapped portions are kept together by the teeth up to such point.

Preferably driving means are provided for the belts so that the belts have a peripheral speed substantially the same as the overlapping roller.

BRIEF DESCRIPTION OF THE DRAWINGS

Further characteristic and the advantages of the interfolding machine, according to the invention, will be made clearer with the following description of an exemplary embodiment thereof, exemplifying but not limitative, with reference to the attached drawings, in which like reference characters designate the same or similar parts, throughout the figures of which.

DESCRIPTION OF A PREFERRED EXEMPLARY EMBODIMENT

Figure 1:
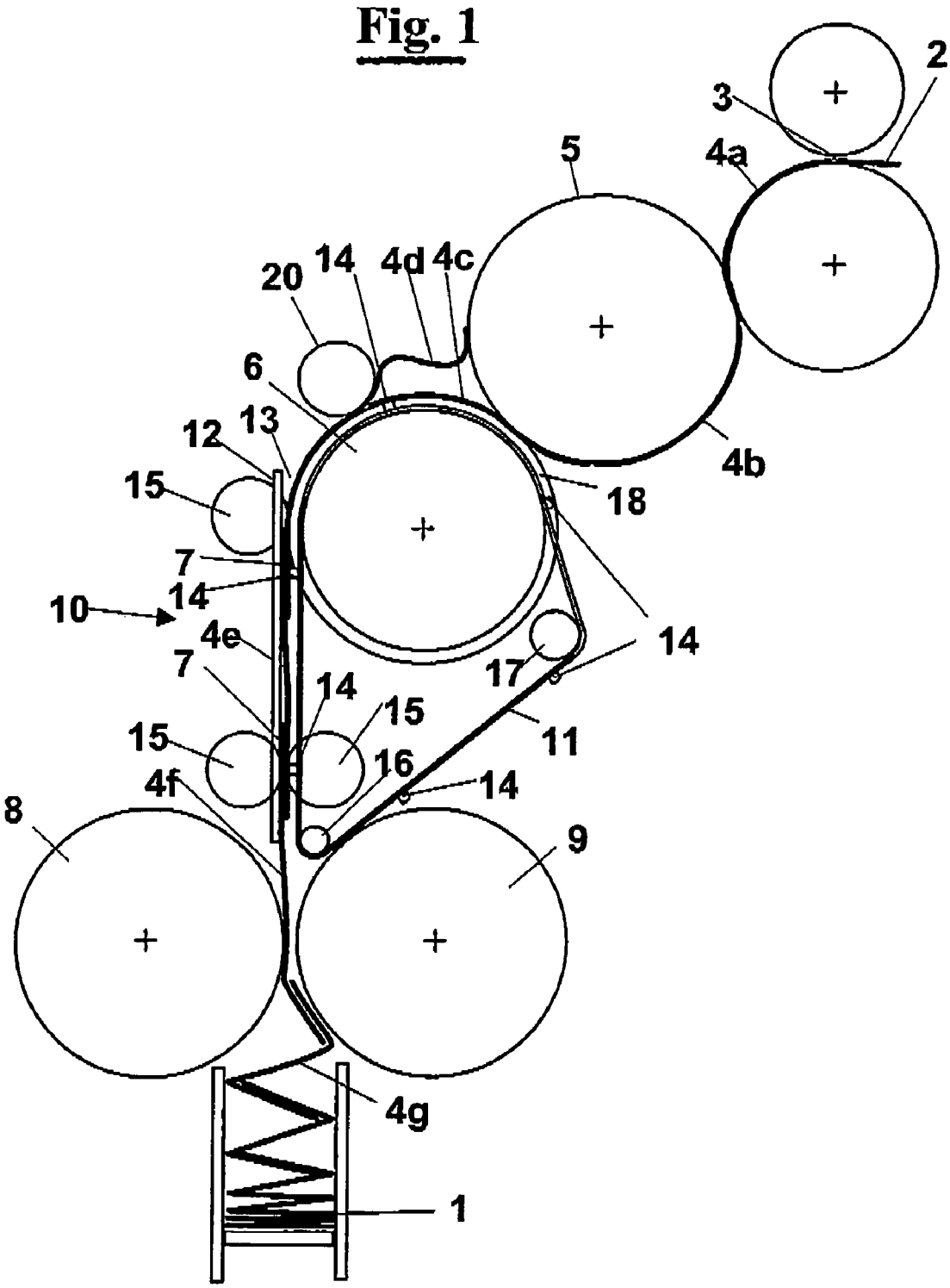
FIG. 1 shows a cross sectional diagrammatical view of an interfolding machine, according to the invention.
Figure 2:
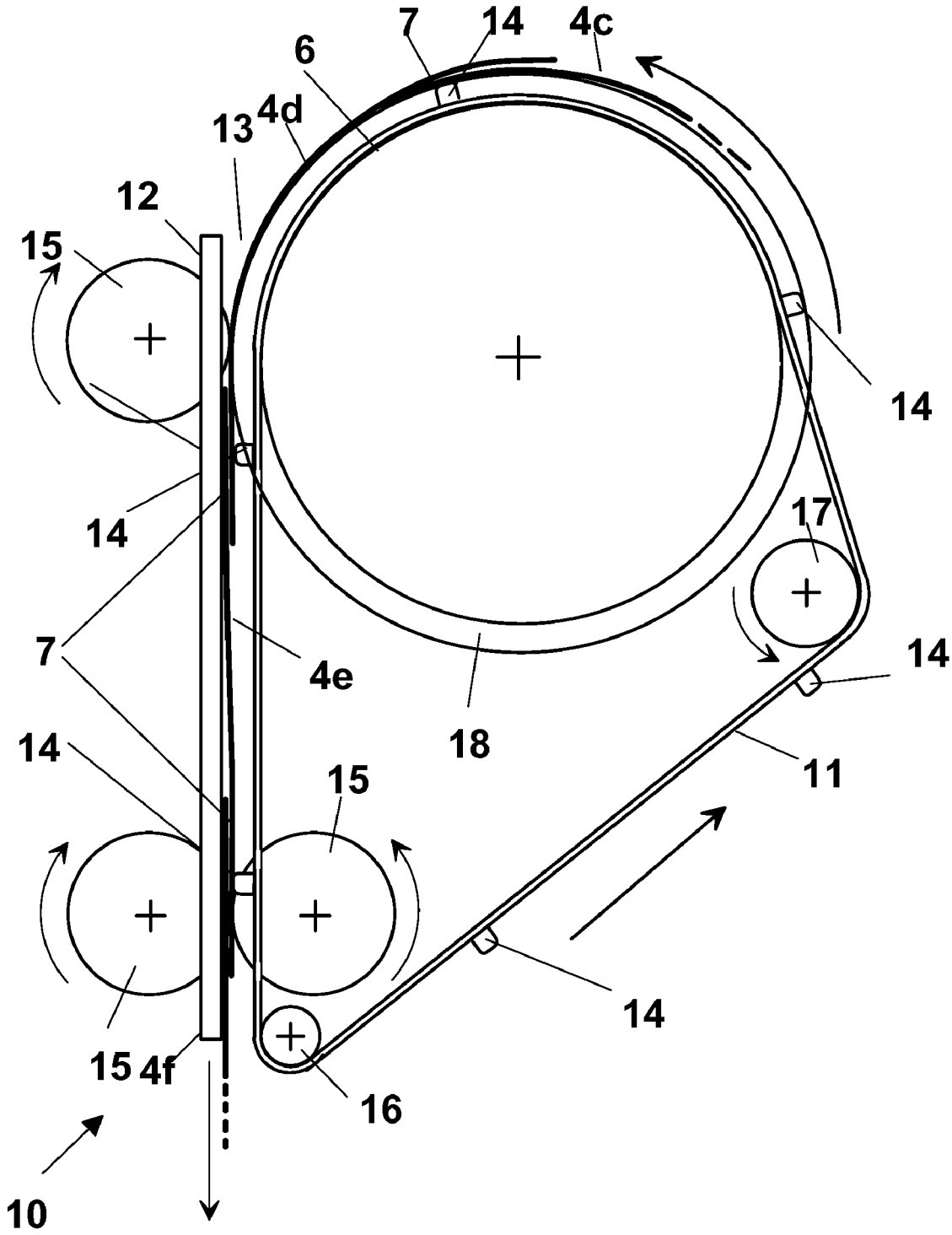
FIG. 2 shows a cross sectional view of the conveying means of the partially overlapped sheets between a overlapping roller and the interfolding rollers.
Figure 3:
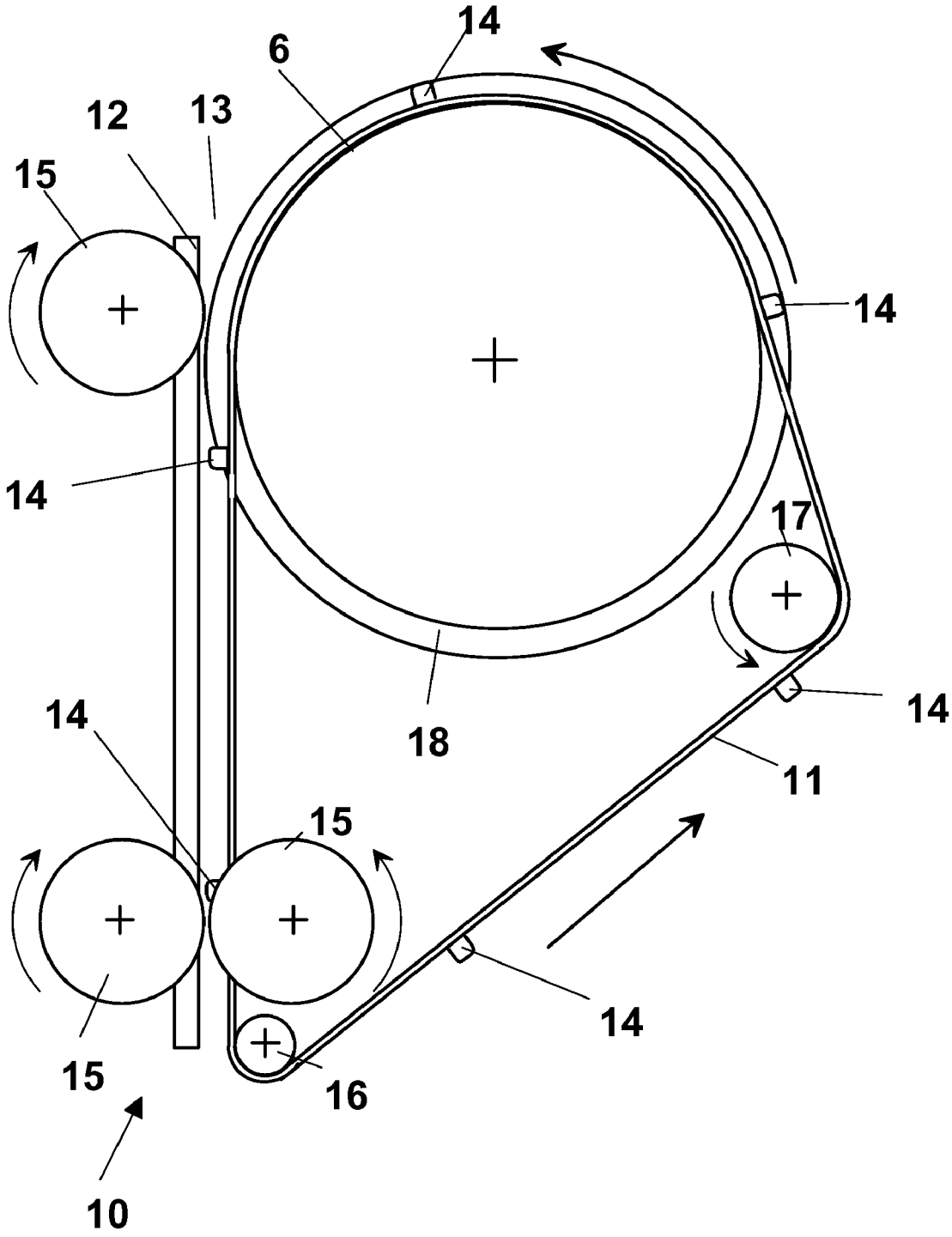
FIG. 3 shows a cross sectional view of the conveying means that is similar to FIG. 2 but without the presence of the sheets.

With reference to FIG. 1, an interfolding machine of a sheet material for making a stack of interfolded sheets 1 uses at least one web 2 of material to interfold, for example paper, non woven fabric. The web 2 is cut by a cutting roller 3 into sheets of predetermined length. The cut sheets, all equal to one another, are carried along the machine and are indicated as 4*a*, 4*b*, 4*c*, 4*d*, 4*e*, 4*f*, 4*g*, starting from the cutting point under the cutter 3 up to the point where they are interfolded.

As well known, at first, the cut sheets 4*a*, 4*b* proceed on a first roller 5 that rotates at a first speed, then they pass on a second roller 6, called "overlapping" roller, which rotates at a second speed less than the first. This way, owing to this speed difference a sheet 4*c* that travels more quickly slides under the sheet downstream 4*d* slower, which is raised at its tail by means of an air blows not shown. The overlapping portion, indicated as 7, between the two sheets 4*c* and 4*d* extends for about a third of their sheet length, in order to allow, downstream of it, to be Z-interfolded, by interfolding rollers 8 and 9 that are adapted to make a stack 1.

Among the "overlapping" roller 6 and the interfolding rollers 8,9 a conveying system is provided 10, adapted to convey sheets 4*d*,4*e*,4*f*, partially overlapped, in a corresponding conveying portion.

More precisely, the operation of the overlapping system is the following (see FIG. 1). The overlapping roller 6 turns slower than the transfer roller. This causes sheet 4*c*, which is transferred by the transfer roller to the overlapping roller 6 owing to vacuum systems not shown, taking the shape of a wave. The production of the wave is assisted by a special small roller 20. Furthermore, the overlapping roller 6 has special concave recesses, not shown in the drawings, for receiving the sheet, which can thus fold partially at the opposite edge. When the tail of the downstream sheet 4*d*, which is still attached to the transfer roller 5, travels through the passage that exists between overlapping roller 6 and transfer roller 5, the head of the upstream sheet 4*c* is transferred by the transfer roller 5 to the overlapping roller 6. This is carried out when the overlapping fraction has a predetermined value, i.e. a third of the sheet length.

The problem that solves the present invention is that of keeping the overlapping portion 7 unchanged when two consecutive sheets leave the "overlapping" roller 6 and are captured by clamps, not shown, of the interfolding rollers 8 and 9. This position has to be kept by touching the least possible the sheets, for not to crease them and pressing them the least possible, in order not to cause them to loose the predetermined shape.

This problem is solved by a system for keeping unchanged the overlapping fraction of sheets 4*d*,4*e*,4*f* comprising a plurality of belts 11 and a plurality of fixed guides 12 facing the belts 11. This way, between the belts 11 and the respective guides 12 a channel 13 is formed through which the sheets can travel freely.

According to the invention, the belts 11 have a plurality of teeth 14 oriented towards the guides 12. The teeth 14 are distanced from each other for the same sheet length, and are phased as the sheets pass such that each tooth 14 coincides with a respective overlapped portion 7.

This way, the teeth 14 press the overlapped portion 7 against the corresponding guides 12, so that sheets 4*d*,4*e*,4*f* that partially overlapped along channel 13 are prevented from changing the overlapped portion.

The conveying system 10 comprises a couple of conveying rollers 15 arranged along the channel, such that at first an overlapping zone 7 in the channel 13, which is located upstream from the conveying rollers 15, the downstream sheet 4*e* is pulled by conveying rollers 15, whereas the upstream sheet 4*d* is only pushed. This way, the overlapping fraction of the sheets 4*d*,4*e* remains unchanged owing to the pressure of the upstream sheet 4*d* against the downstream sheet 4*e* and against the guides by a respective tooth 11. In fact, the upstream sheet 4*d* is kept pressed against the downstream sheet 4*e* at the overlapping portion 7, obtaining, furthermore, a conveying contribution.

The rollers 15 also have function of support for sheets 4*d*,4*e*,4*f*, since have their boundary that protrudes in the channel 13. Furthermore, they have a peripheral speed equal to belts 11.

The belts 11 consist of parallel string belts that follow a loop about rollers 16,17 and about "overlapping" roller 6. The belts 11 are provided for all the sheet length (not shown) of the "overlapping" roller 6, and travel in a respective plurality of grooves 18 made on roller 6 so that the head of the teeth 14 disappears in the grooves 18 in order to push on the overlapping portion 7 between the sheets 4*d* and 4*e* as soon as the belts leave the "overlapping" roller 6.

The belts 11 run parallel to the guides up to a point as close as possible to the interfolding means 8,9. This is possible by arranging a roller 16 at such point as close as possible to the interfolding means 8,9, causing the belts 11 to follow an angle as sharp as possible. This way, the overlapped portions 7 of the sheets are kept together by the teeth 14 up to this point.

The belts have a peripheral speed substantially the same as the overlapping roller 6, by driven roller 17.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

The invention claimed is:

1. Interfolding machine of sheet material for making a stack of interfolded sheets, comprising:

at least one web of material to interfold that is cut into sheets of predetermined length;

means for partially overlapping said sheets in order to form an overlapped portion between two consecutive sheets, where said overlapped portion is a predetermined fraction of said sheet length;

means for interfolding the sheets to form the stack;

means for conveying the partially overlapped sheets in a zone set between said means for partially overlapping and the means for interfolding, and means for keeping constant the overlapped fraction of the sheets between said conveying means and the interfolding means.

2. Interfolding machine according to claim 1, wherein the means for keeping constant the overlapped fraction of the sheets comprises a plurality of belts and a plurality of fixed guides facing on the belts, such that between the belts and respective guides, a channel is formed, the belts having a plurality of teeth oriented towards the guides, and wherein the conveying means comprises a pair of conveying rollers arranged along the channel, whereby at an overlapped portion in the channel, upstream from the conveying rollers, where only a downstream sheet is pulled by the conveying rollers, and the overlapped fraction of the sheets remains constant due to the pressure of the upstream sheet against the downstream sheet and against the guides by the teeth, so that the upstream sheet is kept pressed against the downstream sheet at an overlapping zone, a conveying contribution is obtained.

3. Interfolding machine according to claim 2, wherein the conveying rollers have a boundary that protrudes into the channel and have a peripheral speed equal to the belts.

4. Interfolding machine according to claim 2, wherein the overlapping roller includes a plurality of grooves where the belts are present.

5. Interfolding machine according to claim 2, wherein the belts run parallel to the guides up to a point as close as possible to the interfolding, at said point means being provided for deviating the belts, whereby the overlapped portions are kept together by the same speed of the teeth up to the point.

6. Interfolding machine according to claim 2, additionally comprising means for driving the belts, such that the belts have a peripheral speed substantially the same as the overlapping roller.

7. Interfolding machine according to claim 1, wherein the means for overlapping comprises an overlapping roller and a transfer roller, the transfer roller rotating at a speed higher than the overlapping roller in order to deposit on the overlapping roller the sheets overlapped according to the fraction.

8. Interfolding machine according to claim 7, wherein the fraction is ⅓ of the sheet length, such that a stack is obtained of Z interfolded sheets.

* * * * *